United States Patent [19]

Sasaki

[11] Patent Number: 4,506,255

[45] Date of Patent: Mar. 19, 1985

[54] OPERATION TEST CIRCUIT FOR FIRE DETECTORS

[75] Inventor: Isao Sasaki, Tokyo, Japan

[73] Assignee: Nittan Company, Limited, Tokyo, Japan

[21] Appl. No.: 351,914

[22] Filed: Feb. 24, 1982

[30] Foreign Application Priority Data

Feb. 25, 1981 [JP] Japan ..... 56-25494

[51] Int. Cl.[3] ..... G08B 29/00

[52] U.S. Cl. ..... 340/514; 340/518; 340/502

[58] Field of Search ..... 340/514, 500, 501, 515, 340/516, 537, 577–579, 523, 588, 589, 628–630, 635, 506, 502–505; 169/60, 61, 23; 324/158 F

[56] References Cited

U.S. PATENT DOCUMENTS 3,566,399 2/1971 Weld ..... 340/514

3,848,241 11/1974 Le Nay et al. ..... 340/514

4,024,519 5/1977 Galvin et al. ..... 340/514

*Primary Examiner*—Donnie L. Crosland

*Attorney, Agent, or Firm*—Abelman, Frayne, Rezac & Schwab

[57] ABSTRACT

A test circuit for fire detection systems and the like is designed for use with detectors which bridge across a pair of lines. The detectors become conductive if a condition such as a fire is detected, or if a predetermined number of test pulses is applied to them. Test pulses are applied across the pair of lines. A relay is connected to one of the lines and, when latched, generates an alarm signal. A resistor is placed in series with the relay so the relay cannot latch even when one of the detectors has become conductive. A first circuit produces a confirmation signal when at least one of the detectors is conductive. This signal is delayed in an RC network. A second circuit shorts the resistor after the delayed confirmation signal is received, so that the relay can latch to generate the alarm signal.

11 Claims, 2 Drawing Figures

OPERATION TEST CIRCUIT FOR FIRE DETECTORS

TECHNICAL FIELD OF THE INVENTION

This invention relates to an operation test circuit for fire detectors. More particularly, it relates to a circuit for testing a fire detecting system in which a number of fire detectors are distributed in a plurality of sections, a plurality of detectors in one section are connected to one alarming line for each section, and a plurality of alarming lines are connected to a receiving unit.

BACKGROUND OF THE INVENTION

Today in buildings or any other constructions, the above mentioned fire detecting system is employed.

Conventionally, in order to test fire detectors in such a system, people go over to each respective place where the fire detector is installed, and confirm the operability of each fire detector by raising its temperature using, for instance, a cigarette lighter, or by generating smoke artificially. The test method in which an electrical change to actuate a fire detector is applied to a fire detector to be tested is also known. Even by this method, the inspector must go over to the place where the detector in question is installed. The electrical change can be supplied from the receiving unit side. But a plurality of fire detectors are connected to one alarming line, and therefore, the inspector cannot identify which detector has been actuated, and he cannot select and test a particular detector, either.

I am proposing a selectively actuatable fire detector for the above-mentioned fire detecting system, which counts number of pulses sent from the receiving unit by way of an alarming line, actuates itself when it is designated by the number of pulses, and can reset itself by a second voltage which exceeds a predetermined value, in the simultaneously filed U.S. patent application Ser. No. 351,916, the content of which is incorporated in this application by reference. The invention of this application is directed to a test circuit which is used for testing a plurality of fire detectors in the above-mentioned fire detecting system.

A plurality of fire detectors are connected to one alarming line extending from a section relay installed in the receiving unit of the fire detecting system. Although it is possible to test by disconnecting the alarming line from the section relay, connecting it to a special test apparatus, and giving a predetermined number of pulses for each detector, it is quite troublesome. Also, if a fire breaks out when fire detectors are being tested in this manner, the system cannot give a fire alarm.

The purpose of this invention is to provide an operation test circuit for fire detectors which can be used in the state that all fire detectors are connected to a receiving unit.

DISCLOSURE OF THE INVENTION

According to this invention, in a broader sense there is provided a fire detector test circuit for the fire alarming system comprising a receiving unit, a plurality of section relay means, from each of which an alarming line extends, to said alarming line a plurality of fire detectors being connected, said detectors being connected to a common line, said detector being operated by a first voltage, being provided with a counter which counts number of pulses superposed on the first voltage, generating a signal when counter has counted the predetermined number of pulses, and resetting the counter thereof by a second voltage which is higher than the first voltage; said fire detector test circuit comprising a means which allows passage of electric current necessary for operation of the fire detectors but impairs actuation of the section relay means even when the alarming line and the common line are looped; a first switch circuit which generates an operation confirming signal when the alarming line and the common line are looped; and a second switch circuit which cancel the function of said means which impairs actuation of the section relay means by the output of a delay means, which transmits the operation confirming signal after delaying a period of time.

In a more particular sense, there is provided a fire detector test circuit for the fire alarming system comprising a receiving unit, a plurality of section relay means, from each of which an alarming line extends, to said alarming line a plurality of fire detectors being connected, said detectors being connected to a common line, said fire detector being operated by a first voltage supplied from a first voltage source, being provided with a counter which counts number of pulses superposed on the first voltage, generating a signal when the counter has counted the predetermined number of pulses, and resetting the counter thereof by a second voltage which is higher than the first voltage; said fire detector test circuit comprising an electric current control resistor means inserted between the section relay means and the alarming line; a first switch circuit the control terminal of which is connected to the connection of the current control resistor means and the alarming line, said first switch circuit being turned off when the alarming line and the common line are looped, one end of said first switch circuit being connected to the common line, the other end of said first switch circuit being connected to a second resistor means connected to the first voltage source and a third resistor means connected to a condenser, said condenser being connected to the common line; a second switch circuit which short-circuits the current control resistor means when the voltage of the condenser rises over a predetermined value; a means which supplies pulses to the alarming line via a diode; and a means supplies a second voltage via a diode; whereby an operation confirming signal is generated from the first switch circuit when the fire detector is actuated.

Further a fire detector test circuit which contains additional circuits which make the test operation automatic and quicker is provided.

When I say "pulses which are superposed on the first voltage", I mean the pulses which are literally superposed on the first voltage, that is, intermittent rises of voltage to a third voltage as exemplified below, as well as intermittent interruptions or drops of voltage.

Now the invention is described in detail with reference to the attached drawings.

BRIEF DESCRIPTION OF THE ATTACHED DRAWINGS

DETAILED DESCRIPTION OF THE INVENTION

Figure 1:
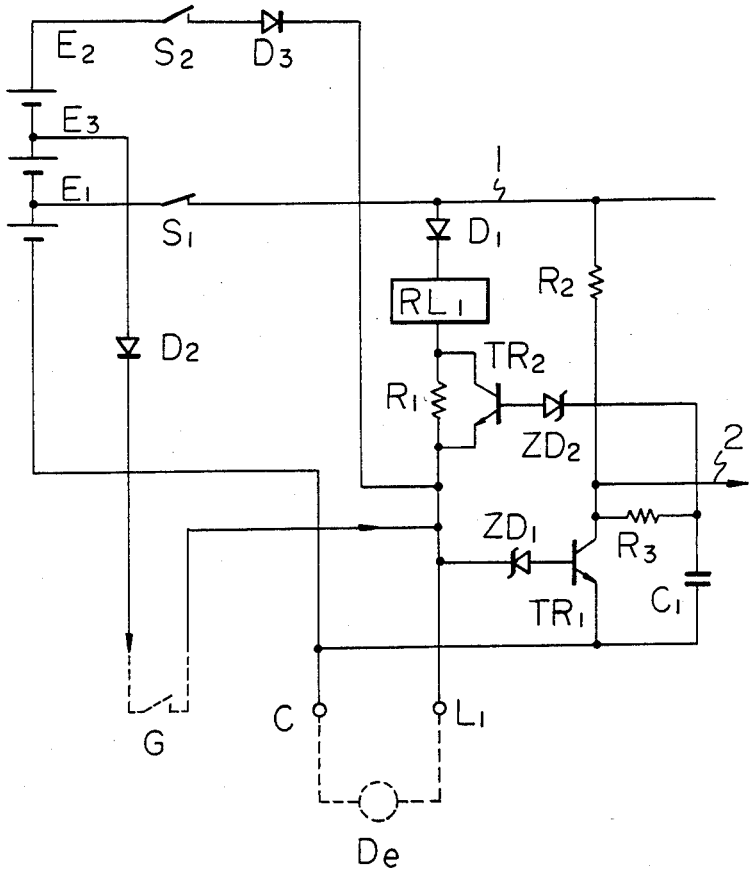
FIG. 1 is a circuit diagram representing an embodiment of this invention.

FIG. 1 shows a circuit representing a fundamental embodiment of this invention. There are provided a first voltage source $E_1$ which supplies a normal fire detector operation voltage i.e. the first voltage $E_1$, a second voltage source $E_2$ which supplies a second voltage $E_2$ to reset the counter of the fire detectors, and a third voltage source $E_3$, which supplies a third voltage higher than the first voltage $E_1$ and lower than the second voltage $E_2$, which actuates the counter of the fire detectors. The first voltage source $E_1$ is connected to a bus line 1 of the receiving unit via a switch $S_1$. To the bus line 1 is connected an alarming line $L_1$ via a reverse current prevention diode $D_1$, a section relay $RL_1$ and a current control resistor $R_1$. To the alarming line $L_1$, a plurality of fire detectors De are connected. The resistance of the resistor $R_1$ is selected so that the section relay $RL_1$ does not operate even when the alarming line $L_1$ and a common line C are looped.

Also, between the bus line 1 and the common line C, a serial connection of a second resistor $R_2$ and a transistor $TR_1$ is inserted, and the base of the transistor $TR_1$ is connected to the alarming line $L_1$ via a Zener diode $ZD_1$. That is, normally a voltage higher than the Zener voltage of the Zener diode $ZD_1$ is given to the transistor $TR_1$ from the bus line 1 via diode $D_1$, section relay $RL_1$ and resistor $R_1$, and the transistor $TR_1$ is in the on state. But, when the alarming line $L_1$ and the common line C are looped by virtue of operation of a fire detector De, the Zener diode $ZD_1$ and thus the transistor $TR_1$ are turned off. The transistor $TR_1$ forms a first switch circuit and the alarming line side of the Zener diode $ZD_1$ forms a control terminal for the switch circuit. Thus, when the fire detector operates and the voltage of the collector of the transistor $TR_1$ exceeds a predetermined value, a signal 2 confirming the operation of the fire detector is transmitted.

The collector of the transistor $TR_1$ is connected to a delay circuit comprising a serial connection of a resistor $R_3$ and a condenser $C_1$, and the condenser $C_1$ is connected to the common line C. The connecting point of the resistor $R_3$ and the condenser $C_1$ is connected to the base of a transistor $TR_2$ via a Zener diode $ZD_2$, and the collector and the emitter of the transistor $TR_2$ are respectively connected to each end of the current control resistor $R_1$. The above-mentioned Zener diode $ZD_2$ and transistor $TR_2$ form a second switch circuit which short-circuits the current control resistor $R_1$ when the voltage of the condenser $C_1$ exceeds a predetermined value.

The above-mentioned third voltage source $E_3$ is connected to a gate circuit or pulse-generating circuit, for instance, a switch G via the reverse current control diode $D_2$, and further to the alarming line $L_1$. The second voltage source $E_2$ is connected to the alarming line $L_1$ via switch $S_2$ and the reverse current control diode $D_3$. A circuit comprising the section relay $RL_1$, the alarming line $L_1$, the first switch circuit, the second switch circuit, etc. is provided for each alarming line and a plurality thereof are connected in parallel, but in FIG. 1 only one of them is shown and the others are omitted.

Operation of this embodiment of the invention is as follow. Normally, when a fire detector operates and the alarming line $L_1$ and the common line C are looped, the voltage of $L_1$ drops, and therefore the transistor $TR_1$ are turned off. Then charging of the condenser $C_1$ from the bus line 1 via resistors $R_2$ and $R_3$ is started, and after some period of time, the transistor $TR_2$ is turned on via Zener diode $ZD_2$. Thus the current control resistor $R_1$ is short-circuited and the section relay $RL_1$ is actuated and a fire alarm is generated via a fire alarm relay (not shown) as in the conventional receiving unit. In the conventional receiving unit, a delay means is provided so that the section relay may not immediately be actuated to generate a misalarming. In the above-mentioned embodiment, there is an advantage that no delay means has to be provided in particular, since alarming is delayed by the above-mentioned operation.

When a fire detector is tested, pulses of the third voltage source $E_3$ are applied to the alarming line via diode $D_2$ by operating a gate G. A fire detector which is connected to the alarming line is actuated and looped the alarming line $L_1$ and the common line C when it learns that it has been designated by the number of pulses of the third voltage $E_3$. Thus the transistor $TR_1$ is turned off, and the collector voltage of the transistor $TR_1$ rises and outputs an operation confirming signal 2. Upon receiving the operation confirming signal 2, the switch $S_1$ is momentarily opened automatically or by manual operation of the switch and thus the self-holding circuit of the actuated detector is reset. As the length thereof is only momentary, the voltage of the condenser $C_1$ is not raised so as to turn on the Zener diode $ZD_2$. As the opening of the switch $S_1$ is only momentary, all the detectors connected to the alarming line $L_1$ remain holding the number of pulses sent from the third voltage source $E_3$ in their counters. In this way, if the third voltage is sent to each detector by operation of each gate, operability of each detector can be tested one by one by adding number of pulses. If a fire actually breaks out during the test, the voltage of the condenser $C_1$ rises and turns on the transistor $TR_2$ via the Zener diode $ZD_2$, and thus the current control resistor $R_1$ is short-circuited and the section relay $RL_1$ operates generating an alarm. That is, the monitoring of a fire is not interrupted by the test of the detectors. Also, the first switch circuit comprises a transistor $TR_1$, and therefore only a small electric current can operate it. The second switch circuit is also operated by very small current, and it is possible to set delay time as desired by selecting Zener voltage of the Zenner diode $ZD_2$, resistor $R_3$ and condenser $C_1$. It will be convenient if a first electric source control circuit (not shown) is provided so that the switch $S_1$ is momentarily opened by the above-mentioned operation confirming signal 2. The first electric source control circuit can be easily composed, for instance, by properly using a transistor which is turned on by said operation confirming signal and a relay, etc.

Figure 2:
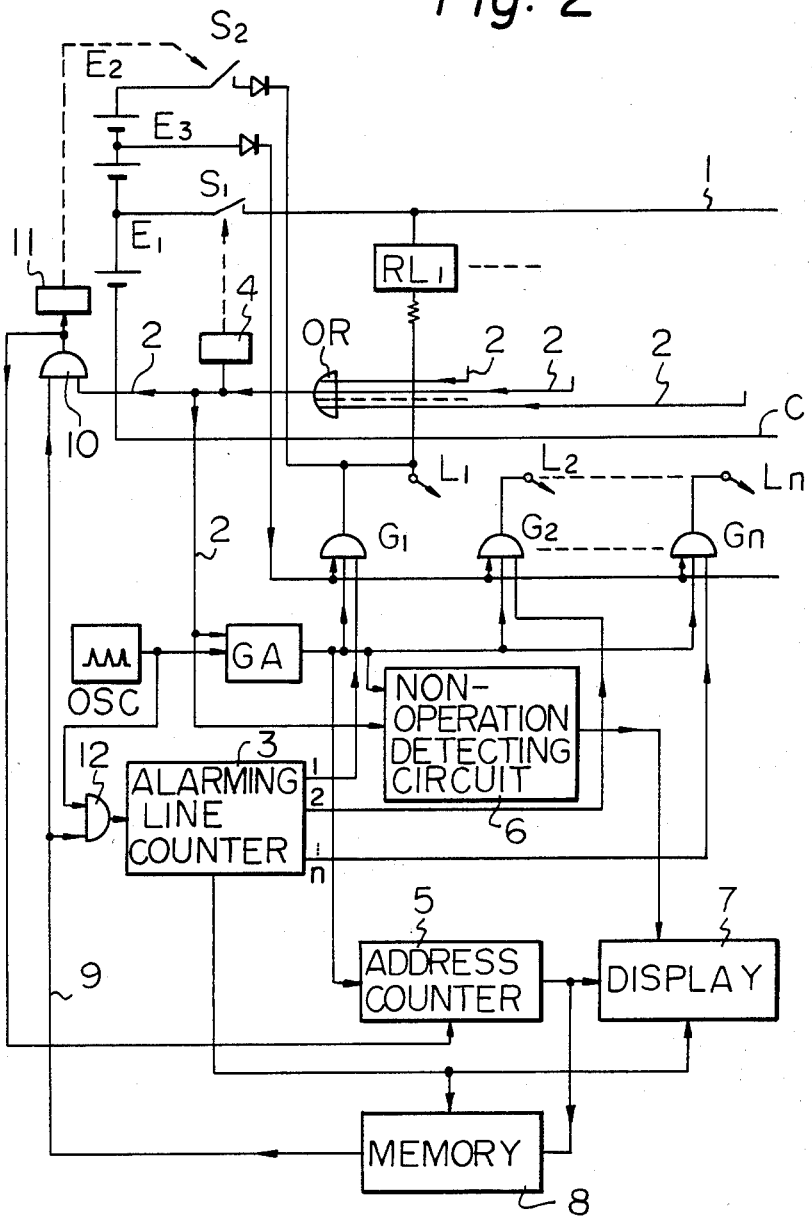
FIG. 2 is a circuit diagram representing another embodiment of this invention in which additional circuits are provided.

Another example of the apparatus of this invention, is illustrated with reference to FIG. 2, which includes additional circuits which are convenient for the testing. However, the additional circuits can be partly or entirely omitted. These can be discretionarily employed and modified by those skilled in the art in the actual application.

AND gates $G_1 \ldots G_n$ are provided so that their output terminals are respectively connected to the alarming lines $L_1 \ldots L_n$, and the third voltage $E_3$ is applied to each of the AND gates $G_1 \ldots G_n$ through one of the input terminals of each of the AND gates. Also a timing pulse generator OSC which generates a pulse series of a predetermined period is provided so that the output thereof is input to a gate GA which is opened by a manually generated actuation signal at the time of actuation and later is opened by the abovementioned operation confirming signal. The output of the gate GA is input to another input terminal of each of the AND gates $G_1 \ldots G_n$. To still another input terminal of each of the gates $G_1 \ldots G_n$, output terminals 1 . . . n of an alarming line counter 3 are connected respectively. The alarming line counter 3 adds an integer 1 every time the test of an alarming line is finished and thus incrementally selects an alarming line.

Suppose that the first output terminal of the alarming line counter 3 is on the high level at first. Then, when the gate GA is opened by an actuation signal from a source not shown the timing pulses generated by the timing pulse generator OSC are input to the AND gate $G_1$ through the gate GA, and the AND gate $G_1$ sends out the third voltage $E_3$ to the alarming line $L_1$. That is, for instance, one pulse of the third voltage is sent out to an alarming line $L_1$. If a fire detector which is connected to this alarming line and has been designated by the number of pulses (one pulse in this case) operates normally, the operation confirming signal is transmitted by the operation test circuit as illustrated in FIG. 1. All the operation confirming signals corresponding to respective alarming lines are input to an OR circuit OR. The output of the OR circuit OR is supplied to the input terminal of the gate GA and an electric source control circuit 4, which is operated by the operation confirming signal 2 and momentarily opens the switch $S_1$ as described with respect to FIG. 1. On the other hand, the gate GA is opened by the operation confirming signal, and the second timing pulse is sent out. In this way, pulses are sent out one by one, all the fire detectors are tested one after another.

If a fire detector does not operate, then the operation confirming signal 2 is not transmitted and therefore the AND gate GA does not open. In order to detect non-operation of fire detectors, a non-operation detecting circuit 6 is provided so as to receive output of the gate GA and the OR circuit OR. The non-operation detecting circuit 6 outputs a signal to indicate the non-operation in a display 7 when the operation confirming signal is not transmitted after timing pulses are output from the gate GA. An address counter 5 is provided, to which output of the gate GA is input and address is counted thereby. The output of the address counter 5 is connected to the input terminal of a display 7. The display indicates the count of the address counter 5 when it receives a signal from the non-operation detecting circuit 6. Thus the non-operating detector and the alarming line to which said non-operating detector belongs are indicated. When operation confirming signal is not input, the gate GA is not opened and therefore the test is interrupted. The inspector can open the gate GA by supplying an actuation signal and thus can resume the test starting with the next detector.

The output of the alarming line counter representing the alarming line under testing and the output of the address counter 5 are input to a memory 8, which is connected to the output terminal of the address counter. The memory 8 memorizes the number of the detectors in the respective alarming line $L_1 \ldots L_n$, and transmits a signal when the output of the address counter 5 reaches the number of the detectors connected to the alarming line being tested. The output of the memory 8 and the output of the OR circuit OR are input to another AND gate 10. The output of the AND gate 10 is input to a second electric source control circuit 11 and the reset terminal of the address counter 5. The output of the AND gate 10 resets the address counter 5 and the second electric current control circuit 11 momentarily closes a switch $S_2$ and sends out the second voltage $E_2$ to the alarming line $L_1$. In this way, all the detectors connected to the alarming line $L_1$ can be reset. On the other hand, the output of the memory 8 and the output of the timing pulse generator OSC are input to the AND gate 12, and the output of the AND gate 12 is input to an alarming line counter 3. Thus, the alarming line counter 3 proceeds with counting by the output of the AND gate 12, and raises the logic level of the second output terminal to the high level and opens the AND gate $G_2$. The same operation is performed with respect to the alarming line $L_2$.

In this way, all the alarming lines are tested one after another. All the above-mentioned operation can be automatically carried out excepting the resuming operation of the non-operation detecting circuit 6, if such a non-operation detecting circuit is provided. The above described operation can be automatically carried out, except the reactuation operation when there is a detector that does not operate.

Industrial Applicability

This invention provides an apparatus for testing operation of a fire detecting system, in which a number of fire detectors are distributed in a building or any construction, and a plurality of fire detectors in a section are connected to a common section alarming line, and a plurality of section alarming lines are connected to a common receiving unit. The operator need not go over to each detector for testing but he can test each detector from the control center. Even during testing, the fire alarming is not obstructed.

I claim:

1. A test circuit for fire alarm systems and the like of a type in which first and second electrical lines are bridged by a plurality of detectors, each detector becoming conductive upon detection of a condition such as fire and upon receipt of a predetermined number of electrical test pulses which are transmitted across said lines, comprising:

means for generating test pulses and supplying them to the detectors;

means for generating an alarm signal when said lines are connected together by at least one conductive detector, said generating means being connected to said first line;

means for disabling said generating means, said disabling means being connected in series with said generating means;

a first circuit for producing a confirmation signal when said lines are connected together by a conductive detector;

a delay circuit for delaying production of said confirmation signal for a predetermined period of time after said lines are connected together by a conductive detector; and a second circuit for deactivating said disabling means in response to production of said confirmation signal, whereby generation of an alarm signal by said generating means is permitted.

2. A test circuit for fire alarm systems and the like of a type in which first and second electrical lines are bridged by a plurality of detectors, each detector becoming conductive upon detection of a condition such as fire and upon receipt of a predetermined number of electrical test pulses which are transmitted across said lines, and being resettable to a nonconductive state by a reset voltage applied across said lines, comprising:

means for generating test pulses and supplying them to the detectors;

relay means for generating an alarm signal when said lines are connected together by at least one conductive detector, said relay means being connected to said first line;

a control resistor for preventing said relay means from latching, said control resistor being connected in series with said relay means;

a first circuit for producing a confirmation signal when said lines are connected together by a conductive detector;

an RC delay circuit for delaying production of said confirmation signal for a predetermined period of time after said lines are connected together by a conductive detector;

a second circuit for shorting across said control resistor in response to production of said confirmation signal, whereby generation of an alarm signal by said relay means is permitted; and means for applying said reset voltage across said lines.

3. The test circuit of claim 1, wherein said first circuit comprises a transistor with its base connected to said first line through a Zener diode.

4. The test circuit of claim 2, wherein said RC delay circuit comprises a capacitor and said second circuit comprises a transistor with its base connected to said capacitor through a Zener diode.

5. The test circuit of claim 1 or 2, further comprising means for momentarily interrupting current flow through said first line in response to production of a confirmation signal.

6. The test circuit of claim 2, wherein the detectors are normally operated on a supply voltage, wherein the test pulses have a voltage exceeding said supply voltage, wherein the reset voltage exceeds the voltage of the test pulses, and wherein the circuit further comprises a gate which is operated by timing pulses and said confirmation signal.

7. The test circuit of claims 1 or 2, further comprising means for detecting when a production of test pulses fails to produce a confirmation pulse.

8. The test circuit of claim 2, wherein said applying means operates in a manner that said reset voltage is produced after a predetermined group of detectors have been tested by application of test pulses.

9. The test circuit of claim 8, wherein there are a plurality of said first lines and said reset voltage is applied to a next one of said first lines after all detectors connected to a prior one of said first lines have been tested.

10. The test circuit of claim 9, further comprising:

a detector address counter for locating an address of a counter under test by counting a number of test pulses supplied to a particular one of said first lines;

an alarm line counter for counting a particular one of said first lines to which test pulses are supplied; and a display device for indicating the particular first line and the particular address of a detector which has been determined to be inoperative after application of test pulses thereto.

11. A test circuit for fire alarm systems and the like of a type in which first and second electrical lines are bridged by a plurality of detectors, each detector becoming conductive upon detection of a condition such as a fire and upon receipt of a predetermined number of electrical test pulses which are transmitted across said lines, comprising:

means for generating test pulses and supplying them to the detectors;

means for generating an alarm signal when said lines are connected together by at least one conductive detector;

means for disabling said generating means;

a first circuit for producing a confirmation signal when said lines are connected together by a conductive detector;

a delay circuit for delaying production of said confirmation signal for a predetermined period of time after said lines are connected together by a conductive detector; and a second circuit for deactivating said disabling means in response to production of said confirmation signal, whereby generation of an alarm signal by said generating means is permitted.

* * * * *